US006863346B2

(12) United States Patent
Zünd

(10) Patent No.: US 6,863,346 B2
(45) Date of Patent: Mar. 8, 2005

(54) CHAIR

(75) Inventor: Roland Zünd, Rebstein (CH)

(73) Assignee: Dauphin Entwicklungs-u. Beteiligungs-GmbH, Neukirchen (DE)

( * ) Notice: Subject to any disclaimer, the term of this patent is extended or adjusted under 35 U.S.C. 154(b) by 143 days.

(21) Appl. No.: 10/339,563

(22) Filed: Jan. 10, 2003

(65) Prior Publication Data

US 2004/0135413 A1 Jul. 15, 2004

(51) Int. Cl.[7] ..... A47C 1/02

(52) U.S. Cl. ..... 297/322; 297/337; 297/300.5; 297/321

(58) Field of Search ..... 297/302.1, 302.4, 297/316, 317, 318, 329, 323, 342, 312, 313, 321, 341, 344.1, 303.1, 303.4, 337

(56) References Cited

U.S. PATENT DOCUMENTS 3,235,308 A * 2/1966 Conner ..... 297/337
4,709,962 A * 12/1987 Steinmann ..... 297/300.3
4,709,963 A * 12/1987 Uecker et al. ..... 297/300.5
4,830,431 A * 5/1989 Inoue ..... 297/300.5
4,858,993 A * 8/1989 Steinmann ..... 297/303.4
4,889,384 A * 12/1989 Sulzer ..... 297/303.4
5,080,318 A * 1/1992 Takamatsu et al. ..... 248/598
5,192,114 A * 3/1993 Hollington et al. ..... 297/300.5
5,328,242 A * 7/1994 Steffens et al. ..... 297/374
5,366,272 A * 11/1994 Lebrun ..... 297/284.11
5,499,861 A * 3/1996 Locher ..... 297/301.2
5,601,337 A * 2/1997 Choda et al. ..... 297/302.1
5,810,440 A * 9/1998 Unwalla ..... 297/316
6,135,556 A * 10/2000 Chu et al. ..... 297/337
6,203,107 B1 * 3/2001 Jonsson ..... 297/337
6,422,649 B2 * 7/2002 Hancock ..... 297/301.5
6,513,222 B2 * 2/2003 Von Ehr et al. ..... 29/434
2001/0050503 A1 * 12/2001 Piretti ..... 297/337
2002/0180248 A1 * 12/2002 Kinoshita et al. ..... 297/284.1
2002/0190558 A1 * 12/2002 Phillips et al. ..... 297/337
2002/0190559 A1 * 12/2002 Phillips et al. ..... 297/337

FOREIGN PATENT DOCUMENTS

DE 4033544 4/1992
DE 19845265 4/2000

* cited by examiner

*Primary Examiner*—Peter M. Cuomo
*Assistant Examiner*—Stephanie Harris
(74) *Attorney, Agent, or Firm*—Browdy and Neimark, P.L.L.C.

(57) ABSTRACT

A chair, in particular an office chair, comprising a pedestal, a seat support supported thereon, a seat plate supported on said seat support, and a backrest secured on said seat support. Said seat support comprises a rear supporting and guiding unit facing said backrest on which said seat plate is supported, and on which said seat plate is guided obliquely relative to the horizontal line against at least one spring element. Said seat support comprises further a front supporting and guiding unit on which said seat plate is supported, and on which said seat plate is displaceably guided.

9 Claims, 5 Drawing Sheets

CHAIR

BACKGROUND OF THE INVENTION

1. Field of the Invention

The invention relates to a chair, in particular an office chair.

2. Background Art

Various office chairs are known. The most simple of them comprise a seat being in a fixed location relative to the chair column. More sophisticated office chairs comprise means for adjusting the inclination of the seat.

SUMMARY OF THE INVENTION

It is an object of the invention to provide a novel office chair better meeting the physiological needs of the users.

This object is attained in a chair, in particular an office chair, comprising a pedestal; a seat support supported thereon; a seat plate supported on said seat support; and a backrest secured on said seat support.Said seat support comprises a rear supporting and guiding unit facing said backrest on which said seat plate is supported and on which said seat plate is guided obliquely relative to the horizontal line against at least one spring element. Said seat support further comprises a front supporting and guiding unit on which said seat plate is supported, and on which said seat plate is displaceably guided.

The main characteristic is to provide a seat which is longitudinally displaceable against a spring force.

Other advantageous configurations of the invention will become apparent from the sub-claims.

Additional advantages and details of the invention will become apparent from the description below of an example embodiment with reference to the drawings.

DESCRIPTION OF THE PREFERRED EMBODIMENT

Figure 1:
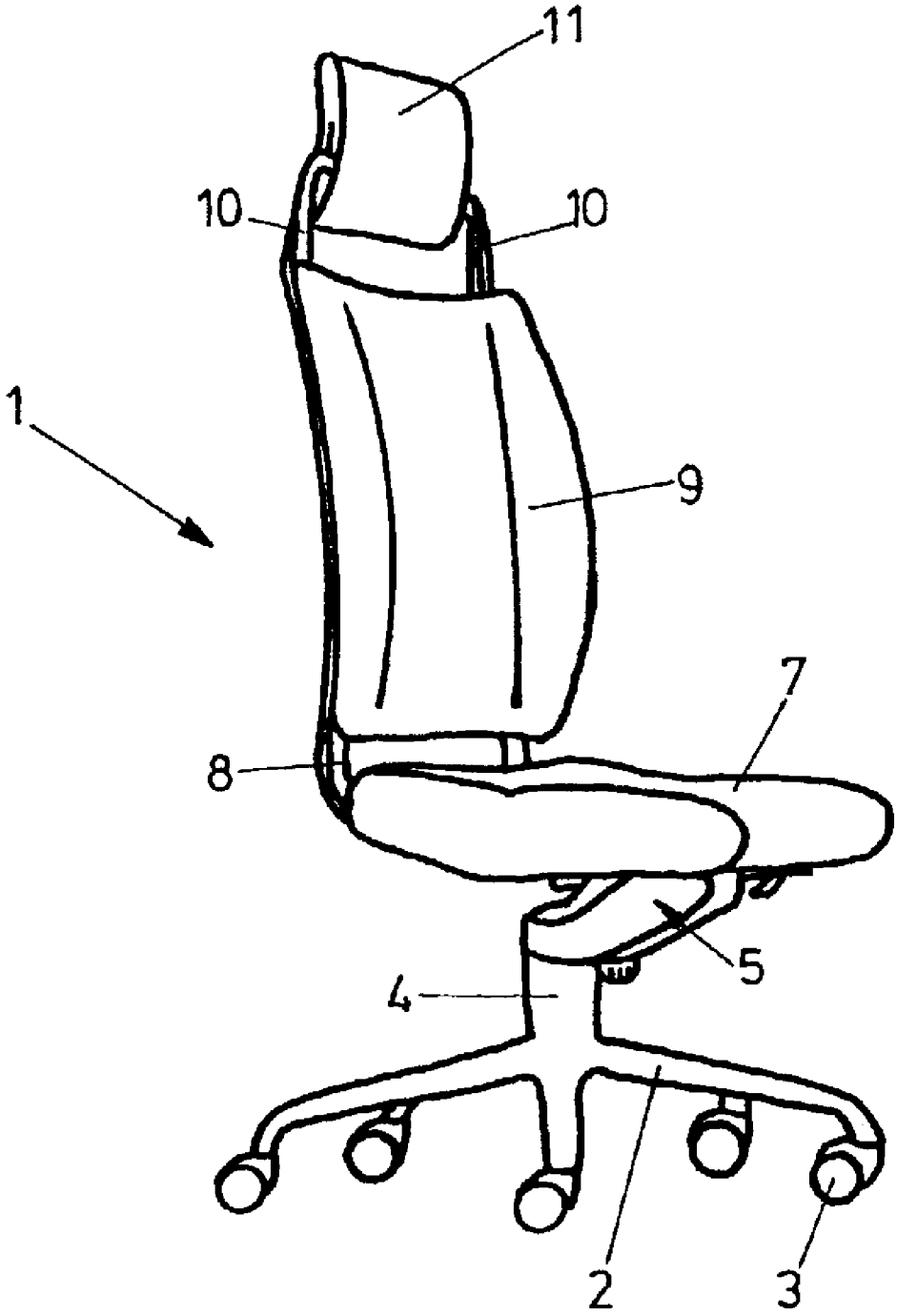
FIG. 1 shows a schematic view of a chair according to this invention.

A chair 1, in particular an office chair, as schematically shown in FIG. 1, comprises a pedestal 2 which is supported via casters 3 on the ground. Attached to the pedestal 2 is an adjustable-height chair column 4 to the upper end of which a seat support 5 is detachably secured on which a seat plate 6 comprising an upholstered seat 7 is disposed. On the rear end of the seat support 5, a backrest support 8 is mounted which extends substantially upwards onto which an upholstered backrest 9 is attached. On the upper end of the backrest support 8, a head rest support 10 is mounted onto which a head rest 11 is secured.

Figure 2:
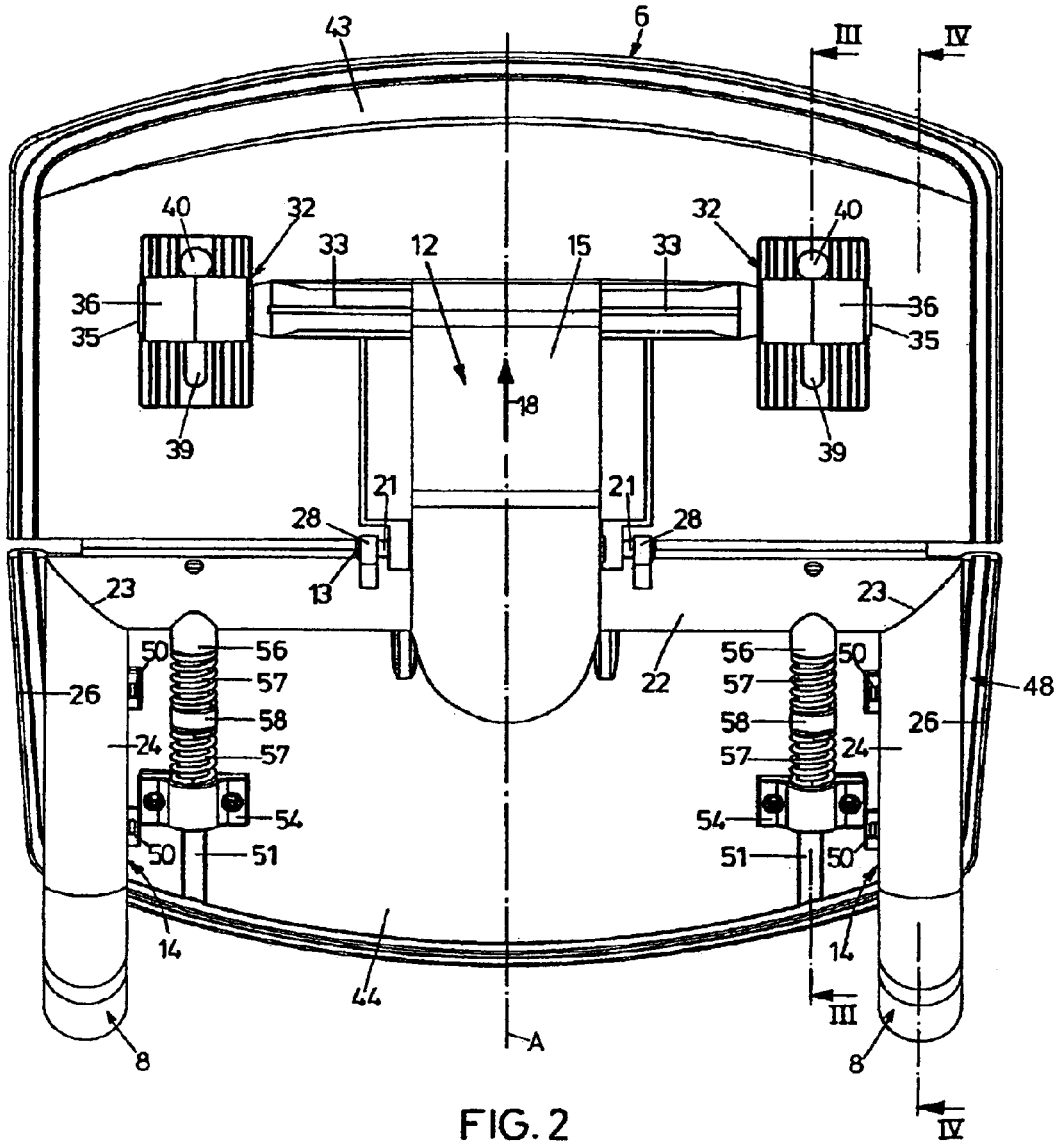
FIG. 2 shows a view from beneath according to FIG. 1.
Figure 3:
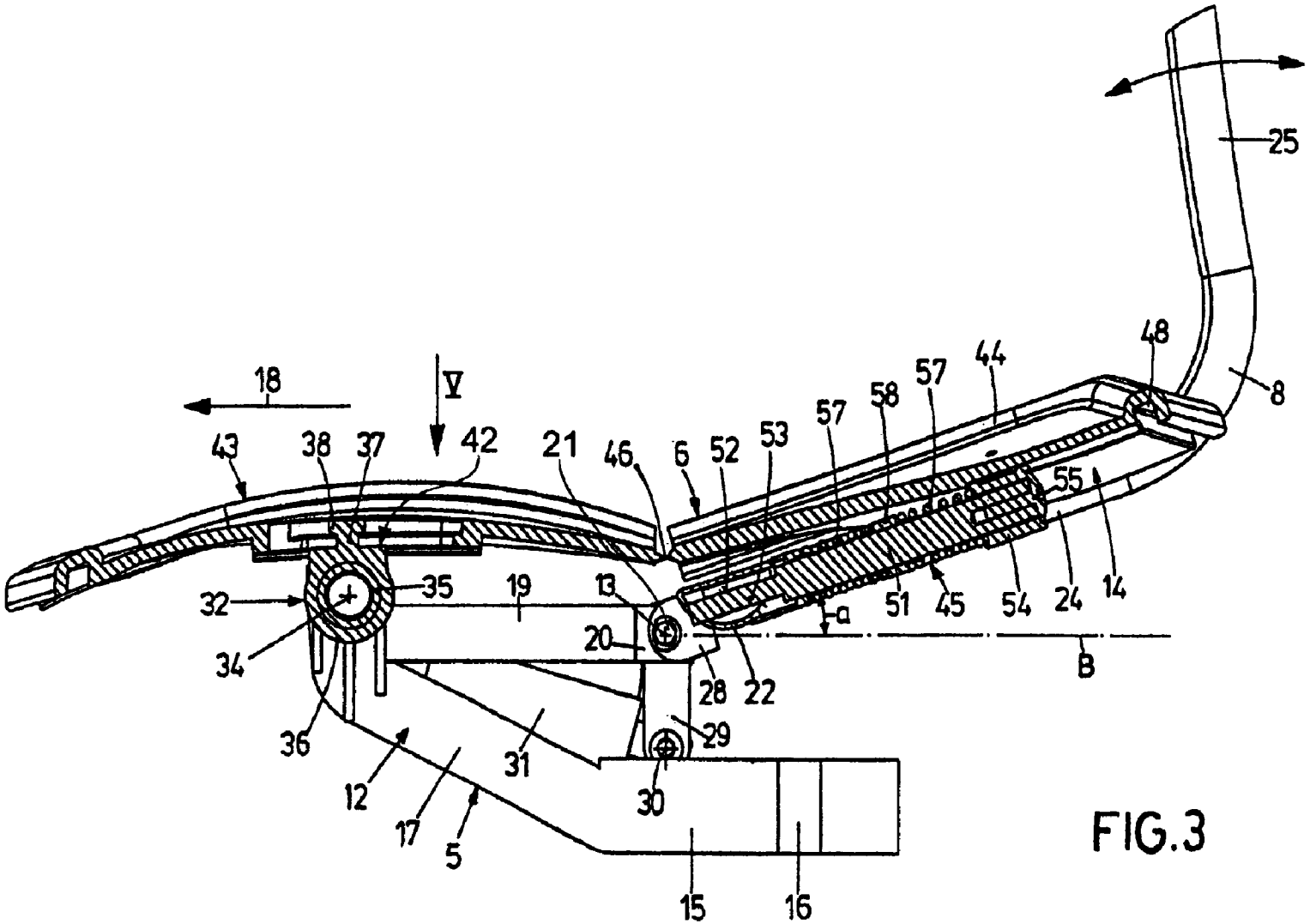
FIG. 3 shows a cross-sectional view on the line III—III in FIG. 2.
Figure 4:
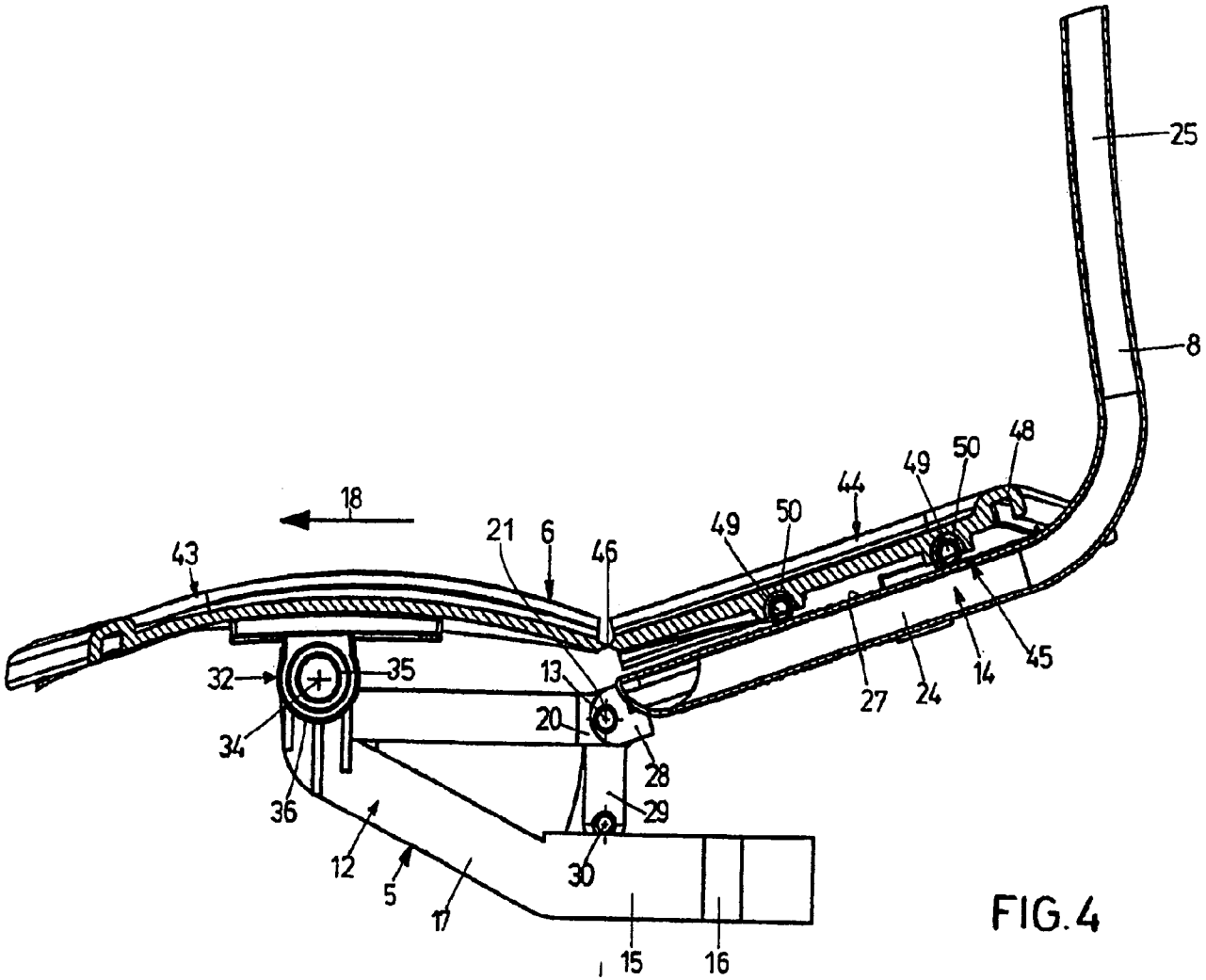
FIG. 4 shows a cross-sectional view on the line IV—IV in FIG. 2.
Figure 5:
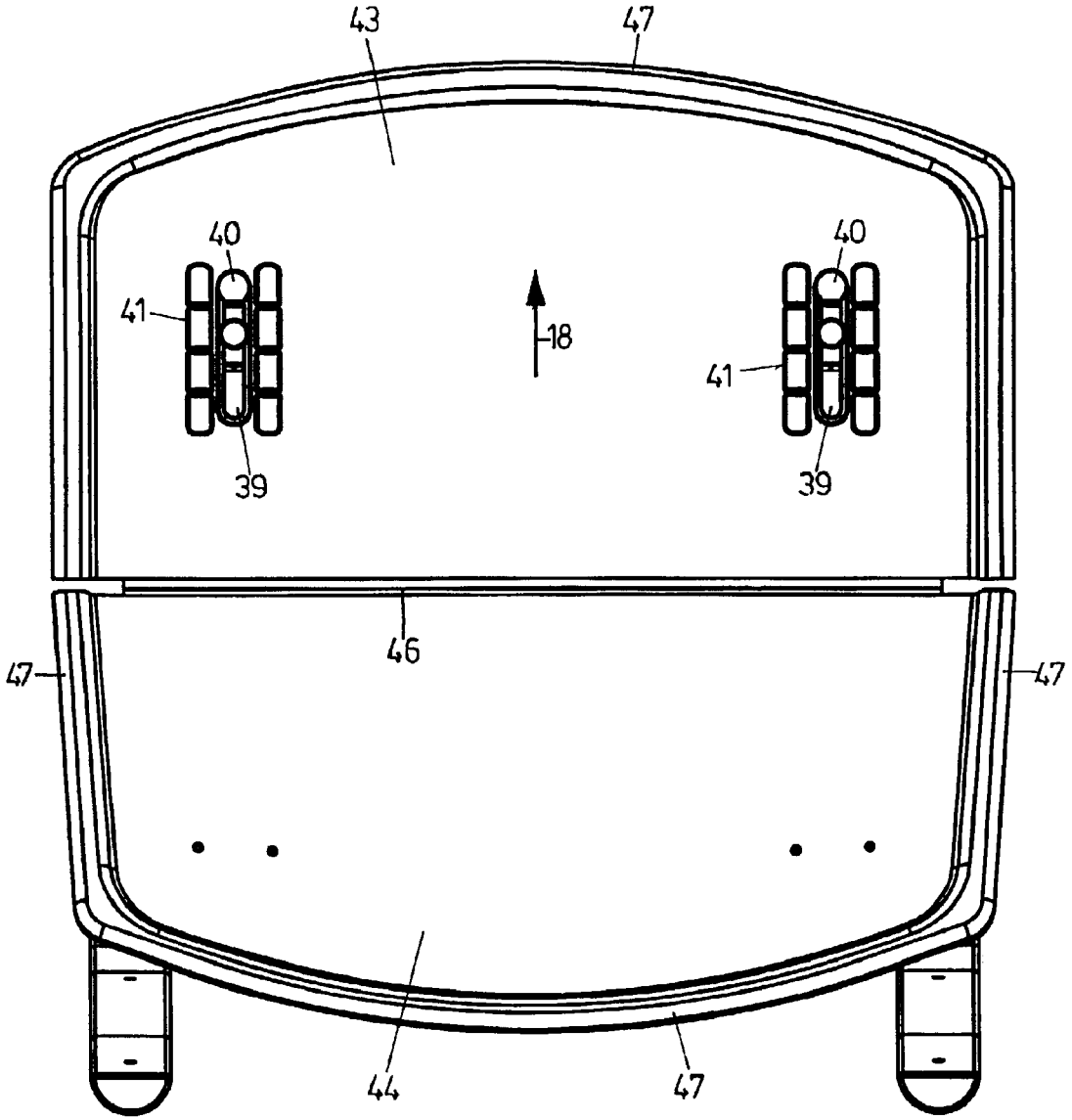
FIG. 5 shows a view according to the viewing arrow V in FIG. 3.

Now, the structure of the seat support 5 and the seat plate 6 is described in more detail with reference to FIGS. 3 through 5. The seat support 5 comprises a front seat support element 12 and a back seat support 14 pivotably mounted on said front seat support element 12 so as to pivot around the pivot axis 13. The seat support element 12 comprises a support 15 extending substantially horizontally having a conical receptacle 16 in which the upper end of the chair column 4 is secured. A support arm 17 extending obliquely upwards is mounted on the front end of the support 15. The chair comprises a horizontal front direction extending from the backrest 9 towards the seat plate 6 corresponding to the viewing direction of a user of the chair 1. A support arm 19 receding horizontally and extending opposite to the direction 18 the free end 20 of which is located above the support 15 is mounted on the front end of the support arm 17. On the end 20 of the support arm 19, the back seat support element 14 is mounted so as to pivot around a shaft 21. The pivot axis 13 extends horizontally. The seat support element 14 comprises, adjacent to the shaft 21, a transverse support 22 extending perpendicularly to the direction 18 while being horizontally arranged and substantially extending across the width of the seat plate 6. On the outer ends 23 of the transverse support 22, two arms 24 being constituent parts of the seat support element 14 are mounted extending obliquely to the upward rear including an inclination angle a with the horizontal line B. The inclination angle a is changeable by pivoting the seat support element 14 around the pivot axis 13, but is generally larger than 0°. The typical range of the inclination angle a lies between 20° and 30°. The arms 24 turn into two stanchions 25 substantially extending vertically forming the backrest support 8. The lateral edge 26 of the seat plate 6 slightly projects in an unsubstantial manner beyond the lateral edge of the arms 24 as shown in FIG. 2. On each of the upper sides of the arms 24, a planar sliding surface 27 is provided which is also inclined against the horizontal line at an inclination angle a and ascends towards the backrest 9. The transverse support comprises two latches 28 projecting in the direction 18 through which the shaft 21 extends and via which the rear seat support element 14 is pivotably mounted on the front seat support element 12. Furthermore, a lever 29 projecting downwards is secured at the centre of the transverse support 22 on the lower end of which lever a force reservoir 31 formed by a longitudinally adjustable gas spring which can be actuated from the outside is mounted via a joint 30. A counter-force is generated via the gas spring 31, e.g. when the user of the chair 1 leans back against the backrest 9. Thus, the rear seat support element 14 and the backrest support 8 are pivotable against a force emerging from the gas spring relative to the front seat support element 12. The chair 1 is designed to be mirror-symmetrical relative to the symmetry axis A.

The seat plate 6 is supported on the front seat support element 12 via a front supporting and guiding unit 32. On the upper front end of the support arm 17, a support tube 33 extending horizontally outwards on both sides is secured which has a central axis 34 extending horizontally and parallel to the pivot axis 13 and the axis of the joint 30. The support tube is centrally arranged beneath the seat plate 6 and extends along approximately three quarters of the width of the seat plate 6. In the region of its two outer ends, the support tube 33 comprises annular cylindrical portions 35 on which a bearing sleeve 36 is pivotable around the axis 34. The two bearing sleeves 36 comprise on their respective upper sides a pin 37 having a radially projecting head 38 wherein the pin 37 is guided in an associated oblong hole 39 in the seat plate 6, i.e. in an oblong hole guidance. The oblong hole 39 comprises at its end towards the direction 18 a key-hole opening 40 through which the head 38 can be inserted for assembling or disassembling the seat plate 6. The width of the head 38 is larger than the width of the oblong hole 39 so that the seat plate 6 is guided displaceably along the direction 18 relative to the bearing sleeve 36, although it cannot be lifted as long as the head 38 is not located in the region of the keyhole opening 40. Parallel to the oblong hole 39, sliding rails 41 made of plastic material as the seat plate 6 and projecting downwards on both sides are provided which are supported on a sliding and supporting plate 42 extending parallel to them which is connected with the sleeve 36 and supported by it. The plate 42 projects in the direction 18 and opposite to it beyond the sleeve 36 and supports the seat plate 6 so that even in the case of a heavy user of the chair 1, bending of the front portion of the seat plate 6 is prevented. Just as the seat plate in this region, the plate 42 is slightly curved upwards, i.e. convex relative to the axis 34.

The seat plate 6 consists of a front seat plate element 43 which is supported against the front supporting and guiding unit, and a rear seat plate element 44 which is supported via a rear supporting and guiding unit 45 against the rear seat support element 14. The seat plate elements 43 and 44 are connected with one another by a joint 46. The joint 46 is a film hinge. The elements 43 and 44 and the joint 46 are integrally formed of plastic material. The front element 43 is curved upwards as mentioned before. The rear element 44 extends evenly. Along its circumference, the seat plate 6 is surrounded, when viewed from the top, by a substantially rectangular, bead-shaped edge 47 which comprises at its inner side a circumferential groove 48.

The rear supporting and guiding unit 45 comprises drum-shaped rollers 49 which are turnably borne in respective bearing recesses 50 provided on the bottom side of the seat plate element 44. Two rollers 49 respectively are arranged one behind the other which are supported on one sliding surface 27 respectively on the two arms 24 to improve the sliding of the seat plate 6 on the sliding surfaces 27. Between the arms 24, two guiding pins 51 extending parallel to the arms 24 are secured on the transverse support 22. To this end, the transverse support 22 comprises bores 52 through which a tapered portion 53 extends which is welded to the transverse support 22. On the bottom side of the rear seat plate element 44, two bearing blocks 54 are mounted which are slidably guided on the guiding pins 51. The guiding pins 51 comprise at their end sides a radially projecting screw 55 screwed into them to prevent the bearing block 54 from sliding off the guiding pin 51. Between the bearing block 54 and an abutment arranged in the region of the transverse support 22 and surrounding the guiding pin 54, a spring element in the form of two spiral springs 57 is provided between which a sleeve 58 is arranged. The sleeve 58 prevents that when the spiral springs 57 are compressed, a portion of the spiral spring abrades the guiding pin 51 causing noise and scratching it. Several small spiral springs 57 arranged one behind the other and led through a sleeve 58 are preferred instead of a single larger spiral spring although it is possible of course to use a single spiral spring on the guiding pin 51. The inclination angle a of the guiding pins 51 relative to the horizontal line B corresponds with the inclination angle a of the sliding surfaces 27 relative to the horizontal line B.

Now the functioning of the chair one is described for the case that the position of the backrest is fixed. When a person sits down on the seat 7 and thus on the seat plate 6, a force is exerted from above onto the rear seat plate element 44. Accordingly, the element 44 is displaced downwards on the slanting plane formed by the sliding surfaces 27 in the left part of FIG. 4 while at the same time the bearing block 54 compresses the spiral springs 57 on the guiding pin 51 so that a counter-force is generated. Due to the displacement of the rear seat plate element 44, the front seat plate element 43 is displaced along the direction 18 on the supporting and guiding unit 32. The displacement of the height of the joint 46 is compensated by pivoting the bearing sleeve 36 around the axis 34 so that no jamming occurs in the oblong hole guidance. The displacement of the seat plate 6 is finished when the counter-force exerted by the spiral springs 57 is equal to the gravity force component exerted by the user along the sliding surface 27 including the frictional force being effective in the system. The displaceability of the seat in accordance with the weight and the position of the point of gravity of the user has numerous advantages. In case of a larger and thus normally heavier person, the seat plate 6 is displaced farther to the front so that the user's thighs are supported better. Furthermore, an automatic adjustment of the elements 43 and 44 of the seat plate 6 relative to the point of gravity of the user takes place so that he/she is automatically supported in keeping an upright sitting position mostly due to the oblique rear seat plate element 44. If the backrest 9 is not fixed but is pivoted by the user, thus changing the inclination angle a of the sliding surface 27, the displaceable seat plate 6 automatically performs a new adaptation to achieve an optimum position of the seat plate.

What is claimed is:

1. A chair, in particular an office chair, comprising a pedestal (2), a seat support (5) supported thereon, a seat plate (6) supported on said seat support (5), a backrest (9) secured on said seat support (5), and comprising a horizontal front direction (18) extending horizontally from the backrest (9) towards the seat plate (6), the horizontal front direction (18) extending parallel to a horizontal plane (B), wherein said seat support (5) comprises a rear supporting and guiding unit (45) facing said backrest (9), the rear supporting and guiding unit (45) comprising at least one sliding surface (27) being inclined against the horizontal plane (B) at an inclination angle a, said seat plate (6) being supported on said sliding surface (27), and said seat plate (6) being guided on said sliding surface (27) against at least one spring element, and wherein said seat support (5) comprises a front supporting and guiding unit (32), on which said seat plate (6) is supported, and on which said seat plate (6) is displaceably guided along the horizontal front direction (18), and wherein said rear supporting and guiding unit (45) comprises at least one guiding pin (51) being surrounded by at least one spiral spring (57).

2. A chair according to claim 1, wherein at least one bearing (54) is secured on said seat plate (6) in which bearing said guiding pin (51) is displaceably guided.

3. A chair according to claim 1, wherein said front supporting and guiding unit (32) is pivotable around a substantially horizontal pivot axis (34) relative to said seat support (5).

4. A chair according to claim 1, wherein said seat plate (6) comprises a front seat plate element (43) and a rear seat plate element (44) being connected with one another via a joint (46).

5. A chair according to claim 1, wherein said seat plate (6) is displaceable towards the front against the spring force of said spring element (57).

6. A chair according to claim 1, wherein two guiding pins extending parallel to one another are provided.

7. A chair according to claim 1, wherein said inclination angle a is changeable.

8. The chair of claim 1 wherein said front supporting and guiding unit (32) comprises at least one guiding pin (37) which is displaceably guided in at least one oblong hole (39) provided in said seat plate (6).

9. A chair, in particular an office chair, comprising a pedestal (2), a seat support (5) supported thereon, a seat plate (6) supported on said seat support (5), a backrest (9) secured on said seat support (5), and comprising a horizontal front direction (18) extending horizontally from the backrest (9) towards the seat plate (6), the horizontal front direction (18) extending parallel to a horizontal plane (B), wherein said seat support (5) comprises a rear supporting and guiding unit (45) facing said backrest (9), the rear supporting and guiding unit (45) comprising at least one sliding surface (27) being inclined against the horizontal plane (B) at an inclination angle a, said seat plate (6) being supported on said sliding surface (27), and said seat plate (6) being guided on said sliding surface (27) against at least one spring element, and wherein said seat support (5) comprises a front supporting and guiding unit (32), on which said seat plate (6) is supported, and on which said seat plate (6) is displaceably guided along the horizontal front direction (18), and wherein said front supporting and guiding unit (32) comprises at least one guiding pin (37) which is displaceably guided in at least one oblong hole (39) provided in said seat plate (6).

* * * * *